United States Patent [19]

Babiol

[11] 4,165,813

[45] Aug. 28, 1979

[54] SECURITY CLOSURE DEVICE FOR BOTTLES

[75] Inventor: Pierre Babiol, Villefranche, France

[73] Assignee: Societe Nouvelle de Bouchons Plastique, Paris, France

[21] Appl. No.: 901,676

[22] Filed: May 1, 1978

[51] Int. Cl.[2] ..... B65D 55/02; B65D 85/56; A61J 1/00

[52] U.S. Cl. ..... 215/220; 215/252

[58] Field of Search ..... 215/220, 252, 256

[56] References Cited

U.S. PATENT DOCUMENTS

| | | | |
|---|---|---|---|
| 3,817,416 | 6/1974 | Costa | 215/256 X |
| 3,944,102 | 3/1976 | Grau | 215/220 X |

*Primary Examiner*—George T. Hall

*Attorney, Agent, or Firm*—Dowell and Dowell

[57] ABSTRACT

The security closure device according to the invention comprises a capsule screwed on said neck, a cap surrounding said capsule and a tearable guarantee strip fast with the capsule, first means being provided between the cap and the capsule for permitting the capsule to be screwed on by actuating the cap, second means being provided for moving elastically the cap in the axial direction after the guarantee strip was torn off in order to permit cooperation of third means for rotatably locking said cap and capsule to allow the capsule to be unscrewed without opposing action from said first means, the capsule being provided with a central raised portion connected to the capsule by an annular U-shaped portion extending into the neck of the container.

5 Claims, 7 Drawing Figures

SECURITY CLOSURE DEVICE FOR BOTTLES

The present invention relates to improved closure devices to be each associated to the threaded neck of a bottle-like container, the opening of which is made very difficult or even impossible for an infant.

As is well known, the manufacturers of those drugs or other products which should not be left within reach of children, so that they cannot be absorbed unexpectedly, look for devices for closing the containers keeping these products such that they can only be opened by a combination of movements based on a principle which is not psychologically assimilable to very young children.

Various solutions have already been proposed but they are generally complicated, which somewhat increase the manufacturing price of the closure devices. Moreover a special neck, i.e. comprising an unusual ring is often required.

The improvements which are the subject-matter of the present invention are provided for realizing such a closure device which can be accommodated on any of the screws necks of the standard bottles and while being of a low enough manufacturing price, can be unscrewed only in two simultaneous operational steps. The invention also proposes to equip the closure device with a violation proof system.

The device according to the invention comprises a capsule screwed on the bottle neck, a cap surrounding said capsule and a tearable guarantee strip integral with the capsule, first means being provided between the cap and the capsule for screwing on the capsule by actuating the cap, and second means being also provided for resiliently moving the cap in the axial direction after breaking the guarantee strip in order to permit cooperation of third means suitable for rotatably locking said cap and capsule to enable the latter to unscrew without opposing action from said first means.

The attached drawings, given as an example, enable better comprehension of the invention, its characteristics and the advantages it can obtain:

Figure 1:
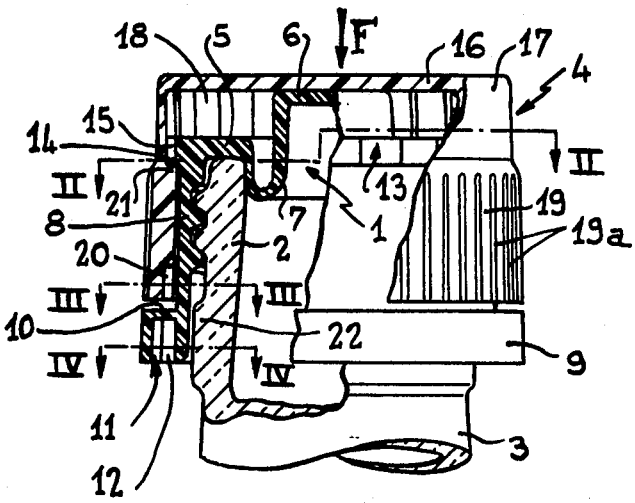
FIG. 1 is a front elevational view partly in section of a device according to the invention which is fitted on the threaded neck of a bottle, said device being represented before the tearing-off of the guarantee strip.

FIG. 1 shows a device according to the invention which substantially comprises a capsule 1 screwed on a threaded neck 2 of a container 3 and a cap 4 which surrounds the capsule 1.

Capsule 1 comprises an annular transverse partition 5 which constitutes a portion of the bottom thereof, the centre 6 of which is raised with respect to partition 5 to which it is connected by means of a thin annular, U-shaped double lip 7. It will be understood that if axial thrust is exerted in the direction of the arrow F at the centre 6 of the bottom of the capsule 1, that centre moves downwards owing to the double lip 7 unrolling itself because of its elasticity. When the thrust is stopped the centre 6 returns elastically to its initial position.

The annular partition 5 is connected to a skirt 8 having an inner face which is threaded to cooperate with the threading of the neck 2. The lower portion of the skirt is surrounded by a split ring which constitutes a guarantee strip 9 connected to the skirt by joining, tearable, bridges such as at 10. Thus, by grasping one of the ends of the strip 9 one can separate it from the skirt by breaking bridges 10. It will be noted that the inner face of said strip 9 and the outline of the skirt 8 delimit an annular space 11, in which there is a toothed crown wheel 12 solid with the corresponding end of the periphery of the skirt 8 of the capsule 1.

Figure 2:
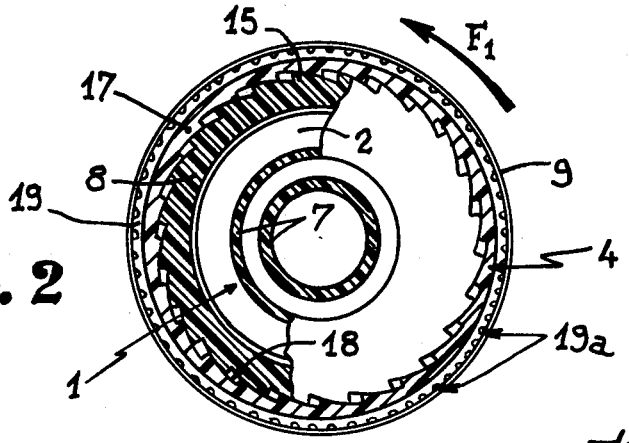
FIG. 2 is a sectional view thereof along the line II-II (FIG. 1).

The partition 5 extends radially so as to form a flange 13 which delimits with the periphery of the skirt a downward shoulder 14. The flange is provided on its periphery with slanting teeth 15 (FIG. 2).

The cap 4 comprises a bottom 16 solid with a tubular sleeve 17 of a small thickness which has on its inner face slanting teeth 18 adapted to cooperate with teeth 15 in the same way as does a ratchet wheel. In other words, when the cap is moved angularly in the trigonometric direction (arrow F1 on FIG. 2) the cap remains stationary, the sleeve 17 expanding elastically to enable the teeth 18 to move with respect to teeth 15.

Figure 3:
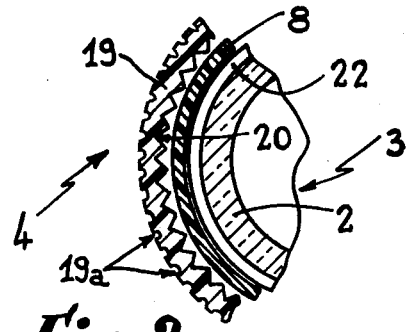
FIGS. 3 and 4 are partial sectional views along the lines III-III and IV-IV (FIG. 1).
Figure 4:
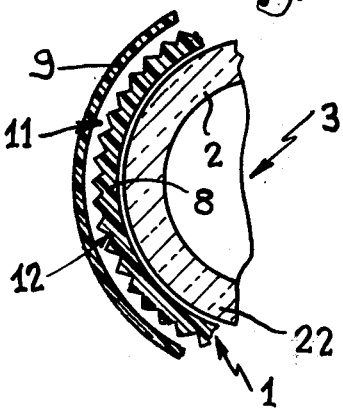

The sleeve 17 extends downwardly into a lateral partition 19 of greater thickness having the bottom of its inner face provided with an inwardly toothed crown wheel 20, the teeth of which are of a shape similar to those of crown 12 of skirt 8 of capsule 1 (FIG. 4). The intersectional area of partition 19 and sleeve 17 is formed as a shoulder 21 oriented upwardly. The crowns 20 and 12 are of such a diameter that their teeth can engage with one another merely by axial displacement of one with respect to the other. In the form of embodiment represented the faces of the teeth are out at 45° for facilitating this engagement (FIGS. 3 and 4).

It is to be noted that the average diameter of the guarantee strip 9 is approximately equal to that of the lower untoothed end of the lateral partition 19.

The cap is made of a semi-rigid material such as polypropylene, whereas the capsule 1 is moulded from a more resilient material so that the connecting bridges 10 can be torn off at their junction with the periphery of the skirt and especially so that the double lip 7 can have the required elasticity. After injection moulding of both elements 1 and 4 the capsule 1 is inserted into cap 4 in the axial direction so that its shoulder 14 is brought to cooperate with the shoulder 21 of the inner face of the lateral partition 19 of said cap. The capsule is then retained axially with respect to the cap 4, the bottom of the latter slightly deforming double lip 7 of the capsule since the bottom 16 of the cap slightly moves the centre 6 of capsule 1 in the direction of the arrow F.

In view of the shape of teeth 15 and 18 the screwing of the cap 4 with respect to the neck 2 allows the capsule 1 to take its position thereon, until the annular partition 5 of the capsule comes to bear on the free end of said neck. The bottle 3 is then closed as shown in FIG. 1. It is of course impossible to unscrew capsule 1 in view of the shape of teeth 15 and 18 as explained above. Moreover the guarantee strip prevents any attempt to bring the crown 20 to the level of crown 12.

Figure 5:
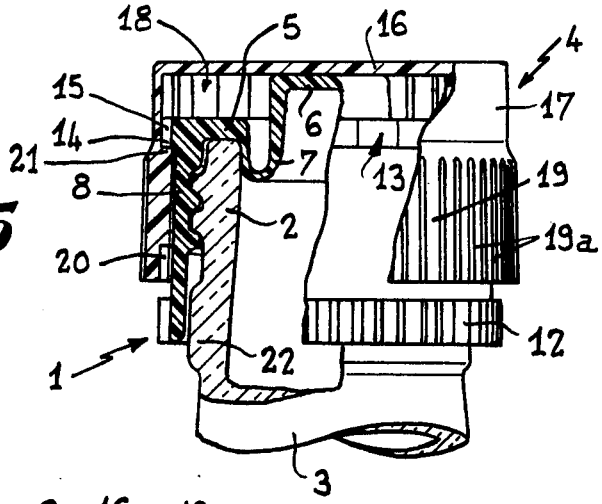
FIG. 5 is a view similar to FIG. 1 but showing the device after the tearing-off of the guarantee strip.
Figure 6:
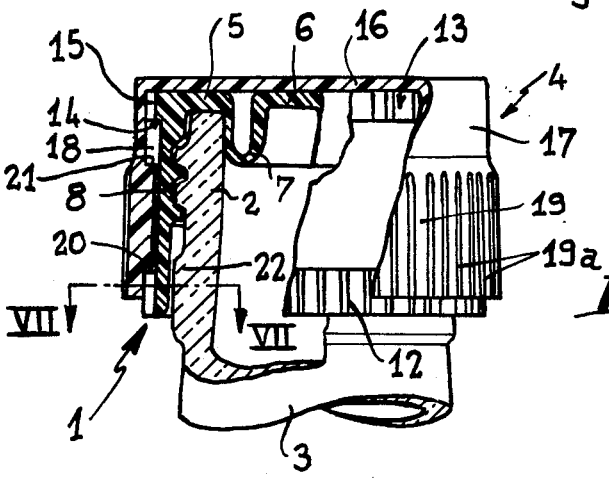
FIG. 6 is a view similar to FIG. 5 but showing the device at the beginning of the unscrewing operation.
Figure 7:
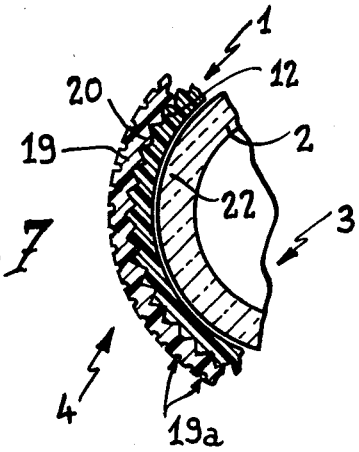
FIG. 7 is a partial sectional view thereof along the line VII-VII (FIG. 6).

In order to be able to unscrew the capsule 1, one has first to tear off the guarantee strip 9, its connecting bridges 10 breaking then at the level of the lateral face of the skirt 8 (FIG. 5). One can thus exert on the bottom 16 of the cap a force in the direction of the arrow F, which causes it to move axially with respect to the capsule against the reaction of the double lip 7 of the capsule (FIGS. 6 and 7).

This axial movement, after suitable orientation of the cap 4, enables crown wheel teeth 20 and 12 to cooperate with each other so that one can communicate to capsule 1 the force exerted on the cap 4 in the reverse direction with respect to arrow F1 on FIG. 2, i.e. in the direction of the unscrewing, if the threads of the neck and capsule run dextrally. When the operator leaves the cap 4 at the end of the unscrewing the elasticity of the double lip 7 provokes disengagement of teeth of crowns 20 and 12, the cap then returning to the position shown on FIG. 5.

For this purpose, the height of teeth 15 of the tubular sleeve 17 is of magnitude larger than the possible downward move of the cap 4. Thus, teeth 15 and 18 remain continuously in mesh during the axial displacements of the cap.

Obviously, the lower portion of the lateral patition 19 of the cap 4 lies higher than the upper face of teeth 12 of capsule 1 to force the user to communicate to the cap an axial thrust before attempting to unscrew the device.

The closure device according to the invention is easy to manufacture and offers the necessary guarantee of safety since it comprises a tearable guarantee strip on the one hand, and on the other hand the opening thereof results from a combination of two movements thereby preventing children in their infancy from getting access to the contents of a container equipped with such a closure device. It is to be noted that the usual ring 22 is mounted on the neck 2 but this does not interfere with the mounting thereon of the device according to the invention. Also noticeable are the outer ribs 19*a* on the lateral partition 19 of cap 4, for facilitating the handling of the latter.

Moreover it should be understood that the preceding description is only given as an example and does not impose limits in any way on the scope of the invention, which contemplates also replacement of the operational elements described by any other equivalent means.

I claim:

1. A security closure device for attachment to the threaded neck of a container, comprising a capsule having an axially extending threaded skirt shaped to screw onto said threaded neck and the capsule having a transverse portion overlying the container neck; a cap surrounding said skirt and having a closed bottom covering said transverse portion of the capsule; cooperating first toothed means carried by the cap and the capsule and operative as a ratchet to tighten the capsule on the threaded neck when the cap is rotated; means for elastically urging the cap axially in one direction with respect to the capsule; a tearable guarantee strip on the capsule preventing axial movement of the cap on the capsule in the other direction until the guarantee strip is torn off; second toothed means carried by the cap and the capsule for rotationally locking the cap and capsule together when the cap is moved in said other axial direction; and said transverse portion of the capsule overlying the neck including an annular U-shaped portion shaped to enter into the neck and having a raised central portion extending outwardly from the neck and abutting the closed bottom of the cap and comprising said means for urging the cap in said one direction.

2. A security closure device as claimed in claim 1, further including shoulder means around the capsule; and shoulder means around the inside of the cap, said shoulder means mutually engaging and cooperating to retain the cap on the capsule pressing the annular U-shaped portion into the neck of the container.

3. A security closure device as claimed in claim 2, wherein the portion of the cap surrounding the skirt of the capsule is an annular sleeve, and said tearable guarantee strip surrounding the skirt of the capsule below the sleeve and being integrally attached to the skirt at a zone of lesser strength, the strip preventing movement of the sleeve axially on said skirt in said other direction to further press the U-shaped portion into the neck.

4. A security closure device as claimed in claim 1, wherein said cooperating first toothed means comprises teeth on the cap and on the capsule slanted so that when the cap is rotated in the direction to unscrew the capsule from the neck, the cap will expand in diameter to permit the teeth on the cap to slip over the teeth on the capsule.

5. A security closure device as claimed in claim 4, wherein the teeth of said first toothed means extend sufficiently in the axial direction to remain mutually engaged when the cap is moved in either direction on the capsule.

* * * * *